United States Patent [19]

Thettu et al.

[11] 3,947,108

[45] Mar. 30, 1976

[54] CLEANING SYSTEM

[75] Inventors: Raghulinga R. Thettu, Webster; Donald J. Quant, Rochester, both of N.Y.

[73] Assignee: Xerox Corporation, Stamford, Conn.

[22] Filed: May 20, 1974

[21] Appl. No.: 471,524

[52] U.S. Cl. ..... 355/15; 118/637; 355/17; 427/444

[51] Int. Cl.[2] ..... G03G 21/00

[58] Field of Search..... 355/15, 3 DD, 10, 17; 117/17.5, 37 LE; 118/637

[56] References Cited

UNITED STATES PATENTS

| | | | |
|---|---|---|---|
| 2,889,758 | 6/1959 | Bolton | 355/15 X |
| 3,411,932 | 11/1968 | Malone et al. | 355/17 X |
| 3,552,850 | 1/1971 | Royka et al. | 355/15 |
| 3,724,020 | 4/1973 | Till | 355/15 X |
| 3,770,429 | 11/1973 | Kinoshita et al. | 355/15 X |
| 3,776,632 | 12/1973 | Smith et al. | 355/15 |
| 3,781,107 | 12/1973 | Ruhland | 355/15 |
| 3,807,853 | 4/1974 | Hudson | 355/15 |

OTHER PUBLICATIONS

*IBM Tech. Bull.*, "Brush Material for Cleaning Electrophotographic Plates," by W. Crooks, Vol. 12, No. 7, p. 1046, Dec. 1969.

*IBM Tech. Bull.*, "Force Loaded Cleaning Station," by R. V. Davidge et al., Vol. 16, No. 4, Sept. 73, p. 1265.

*IBM Tech. Bull.*, "Photoconductor Cleaning Station," by M. K. Bullock et al., Vol. 16, No. 4, Sept. 1973, pp. 1268–1270.

*IBM Tech. Bull.*, "Cleaning of Reusable Photoconductive Insulators," by W. Crooks, May 1970, p. 2285, Vol. 12, No. 12.

*IBM Tech. Bull.*, "Cleaning Brushes that Prevent Clear Film Streaking," P. H. Harmon et al., Oct. 1972, Vol. 15, No. 5, p. 1434.

*IBM Tech. Bull.*, "Photoconductor Cleaning System," by T. M. Hider, Vol. 9, No. 11, Apr. 1967, p. 1528.

*Primary Examiner*—R. L. Moses

*Attorney, Agent, or Firm*—Paul Weinstein; Clarence A. Green; James J. Ralabate

[57] ABSTRACT

An improved cleaning apparatus and process are provided including a cleaning means for removing toner particles and other particulate contaminants. A contaminant removal means is provided positioned between the cleaning means and the means for charging an electrostatic imaging member. The contaminant removal means which comprises a scrubber member is adapted to remove film-like contaminants which would otherwise cause deletions in the resulting copy sheet.

11 Claims, 4 Drawing Figures

CLEANING SYSTEM

CROSS REFERENCE TO RELATED APPLICATION

U.S. application Ser. No. 465,719, filed Apr. 30, 1974, to Thomas D. McMullen et al. for a Contamination Removal Device and Process.

BACKGROUND OF THE INVENTION

This invention relates to an apparatus and process for removing film-like contamination from the surface of an electrostatic imaging member. The invention is particularly adapted for use in a xerographic reproducing machine.

In some xerographic reproducing machines film type contamination on the surface of the photoconductive plate has been found to cause deletions in the image on the copy sheet. These deletions are believed to occur due to lateral surface conduction in the contaminant film which has the effect of discharging portions of the electrostatic image on the photoconductive plate. Those portions of the image which have been so discharged then show up as deletions in the resulting copy sheet. The film material is believed to be made up principally of organic components including toner degradation products and other species as well as one or more inorganic elements or compounds. These film type contaminants are believed to be derived from environmental sources, both internal and external of the machine. Contamination films of this type have been found to be resistant to conventional xerographic plate cleaning procedures such as the use of a resilient cleaning blade.

Various procedures for removing residual toner particles and other types of particulate components from the surface of an electrostatic imaging member are known, as for example, the use of resilient blades, brushes, webs, or the like. Numerous systems have been proposed wherein more than one cleaning element is provided in order to have redundancy in the cleaning system. Thereby, if the first cleaning element fails or incompletely removes toner particles, the second cleaning element will remove those remaining particles. For example, U.S. Pat. No. 3,552,850, granted Jan. 5, 1971, to Royka et al discloses the use of multiple cleaning blades. In U.S. Pat. No. 3,795,025, the use of multiple brushes as a cleaning system is disclosed. In German Offenlegungsschrift, No. 2,111,509, laid open for public inspection Sept. 23, 1971, there is disclosed a redundant cleaning system comprising a blade which removes the predominant portion of any residual toner particles and a cleaning roller following the blade for removing any remaining particles. The surface of the roller is covered with a coating of woven or knitted cloth, suede or the like. It is alleged that the wiper and the roller operate according to different principles so that their disadvantages are balanced and complete cleaning can be achieved. It is not known whether these redundant cleaning systems would be effective to remove contaminant films of the type described above.

In addition to the foregoing prior art, there is provided in U.S. Pat. No. 3,664,300, granted May 23, 1972, to Joseph, a system for applying lubricants to the surface of an electrostatic imaging member. In accordance with one embodiment thereof, a bar brush applicator is employed. The lubricant applicator may be located in the imaging cycle following a cleaning system or as described and shown it may act in a dual fashion as the basic cleaning system.

SUMMARY OF THE INVENTION

In accordance with this invention an apparatus and process are provided including a cleaning means for removing toner particles and other particulate contaminants. A contaminant removing means is provided positioned between the cleaning means and the means for charging the electrostatic imaging member. The contaminant removing means is adapted to remove film type contaminants, particularly contaminants as described above which would otherwise cause deletions in the resulting copy sheet. The contaminant removing means is sufficiently abrasive to scrub the surface of the imaging member to dislocate and/or remove any deleting films thereon. The contaminant removal means preferably comprises a scrubber element comprising a brush, pad, or roller which may be stationary or it may rotate, or oscillate, or otherwise move with respect to the surface of the drum. Preferably, the cleaning means comprises a blade cleaning system.

Therefore, it is an object of this invention to provide an apparatus for removing contaminant films from the surface of an electrostatic imaging member.

It is a further object of this invention to provide a reproducing apparatus including the above-noted apparatus.

It is a further object of this invention to provide a process for removing contaminant films from the surface of an electrostatic imaging member.

These and other objects will become more apparent from the following description and drawings.

DETAILED DESCRIPTION OF THE PREFERRED EMBODIMENTS

Figure 1:
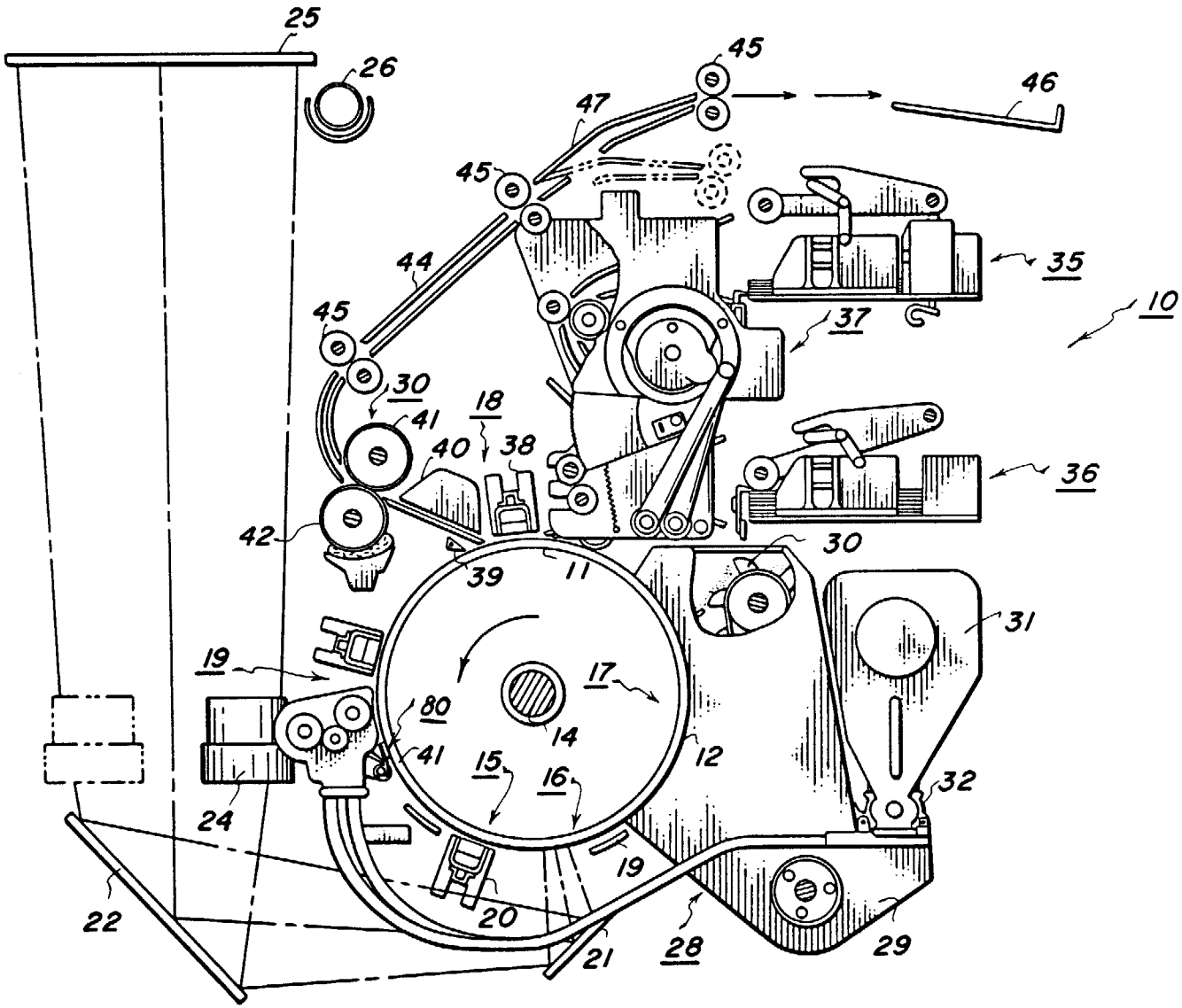
FIG. 1 is a schematic view of an exemplary xerographic type copying machine incorporating the improved contamination removal apparatus of the present invention.

Referring to the drawings, there is shown, for purposes of explanation, a xerographic type copying machine, designated generally by the numeral 10, incorporating the improved cleaning apparatus of the present invention. Copying machine 10 has a drum-like part 11, the exterior surface 12 of which is finished with a suitable electrostatic imaging or photoconductive material in a manner known to those skilled in the art. Drum 11, which is suitably journaled by means of shaft 14, rotates in the direction indicated by the solid line arrow of FIG. 1 to bring the photoconductive surface 12 thereof past a plurality of xerographic processing stations as will appear more fully herein. Suitable drive means are provided to drive the various operating components of copying machine 10.

While a cylindrical or drum shaped photoconductive part 11 has been shown herein, other configurations, such as a flat plate, belt, or the like may be contemplated.

The xerographic processing stations of copying machine 10 include a charging station 15, wherein an electrostatic charge is deposited on the photoconductive surface 12 preparatory to imaging; an exposure station 16 where a light radiation transmitted image of the document being copied is projected onto the photoconductive surface 12 to form a latent electrostatic image; a developing station 17 where a suitable xerographic developing material including ink or toner particles is cascaded onto the drum surface 12 to develop the latent electrostatic image on the drum surface; a transfer station 18 where the toner defined image is electrostatically transferred from the surface 12 of drum 11 to another surface, normally the copy sheet; and a drum cleaning and toner collecting station 19 where the surface of drum 11 is cleaned in preparation for reuse thereof.

Charging station 15 includes a suitable corona generator 20, the discharge electrode or electrodes of which extend in spaced relation transversely across the drum surface in a direction generally parallel to the axis of drum 11. A suitable source of electrical energy is provided for corona generator 20 together with suitable shielding means to direct the charge emitted therefrom toward the drum surface.

Exposure station 16, which is downstream of charging station 15, has an image mirror 21 arranged opposite the surface 12 of drum 11 and adapted, via object mirror 22 and movable lens 24, to transmit an image of the document being copied onto the photoconductive surface 12 of the rotating drum 11 as the surface 12 moves therepast. The document being copied is supported by a transparent platen 25, a suitable illuminating device such as lamp 26 being provided to illuminate the document during the copying process. Lens 24, which is optically positioned below platen 25, moves along a path generally parallel to platen 25 in timed relation to rotation of drum 11.

Figure 2:
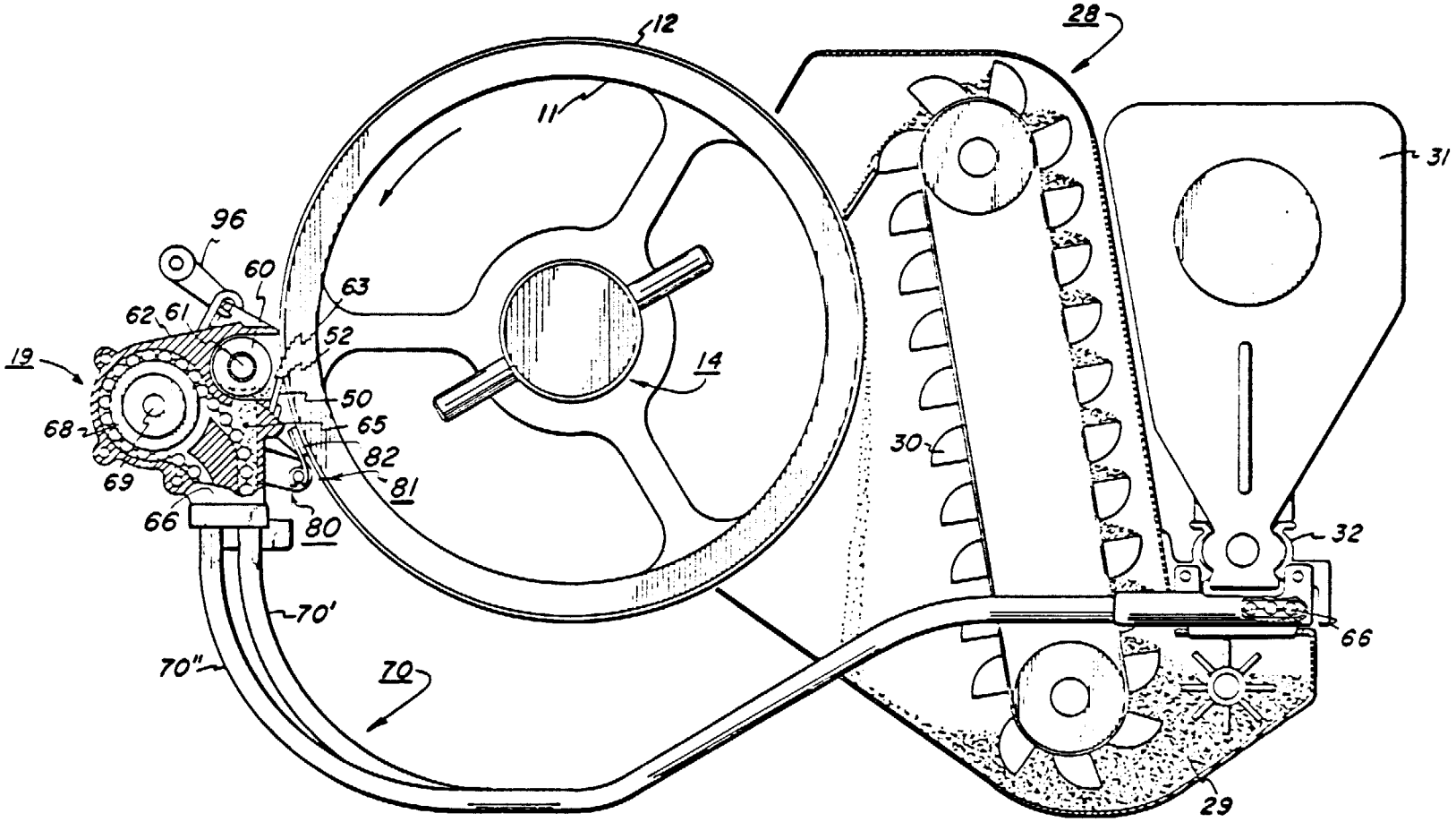
FIG. 2 is an enlarged side view with parts broken away showing details of the copying machine cleaning apparatus.

Developing station 17 is downstream of exposure station 16 and as best seen in FIG. 2, includes a developer housing 28, the leading edge of which is complementary to drum 11. The portion of housing 28 forms a sump 29 within which a quantity of xerographic developing material is stored. A bucket type conveyor 30 is provided for bringing the developing material from the sump 29 to the drum surface 12, conveyor 30 serving at the discharge point thereof to cascade the developing material downwardly onto the upwardly moving photoconductive surface 12 of drum 11. As will be understood by those skilled in the art, the toner particles deposited onto the drum surface are electrostatically attracted thereto in a pattern complementary to the charge pattern on the photoconductive surface 12 to develop the xerographic image. Unused developing material falls back into the sump 29. Toner is supplied to sump 29 from plastic supply bottle 31 through an automatic dispensing apparatus 32. In addition, and as will appear more fully, toner removed from drum 11 at the toner cleaning and recovery station 19 is returned to sump 29.

Referring again to FIG. 1, image transfer station 18 is downstream of developer station 17. There, individual copy sheets drawn from either upper feed tray 35 or lower feed tray 36 are brought, by sheet feeding mechanism 37, into transfer relationship with the surface 12 of drum 11 where the developed image is electrostatically transferred from drum 11 to the copy sheet by means of transfer corotron 38 in a manner known to those skilled in the art. A stripper finger 39, operatively supported adjacent the surface 12 of drum 11 downstream of corotron 38, serves to remove or strip the copy sheet from drum 11 and onto vacuum transport 40. Transport 40 carries the image bearing copy sheet forward into the nip formed by fuser roll pair 41, 42. There a combination of heat and pressure functions to fix the toner image on the copy sheet as the sheet moves through the rotating fuser roll pair 41, 42 and into the sheet return track 44. Return track 44 includes pinch rolls 45 to carry the copy sheet to output tray 46.

A movable guide mechanism 47 is provided to allow the copy sheet to be alternatively routed into the upper feed tray 35. From there, the copy sheet can be run back through the copying machine 10 to image the reverse side thereof following which the new image is fixed and the finished copy sheet having images on both sides discharged into output tray 46.

The drum cleaning and toner recovery station 19, which is downstream of the transfer station 18 and upstream of the charging station 15 serves to clean residual toner from the surface of drum 11 following image transfer. The removed toner is returned to sump 29 of developer housing 28 for reuse.

Figure 3:
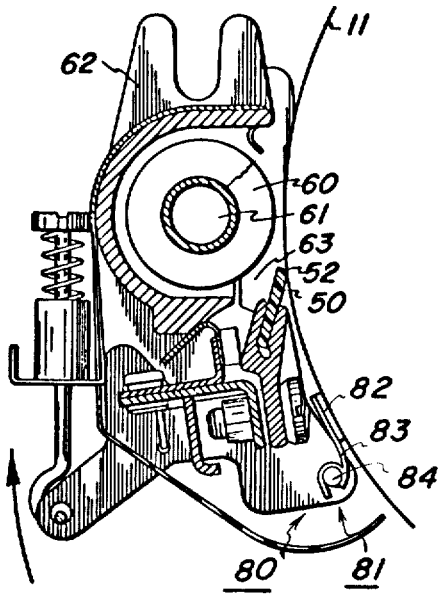
FIG. 3 is a cross-sectional view showing details of the apparatus of the present invention.

Referring particularly to FIGS. 2 and 3, toner cleaning and recovery station 19 includes a relatively soft, flexible cleaning blade 50. Blade 50, which oscillates back and forth across drum 11 during cleaning, has a leading edge 52 in contact with drum surface 12. Since the normal imaging or working width of drum surface 12 is somewhat less than the overall width of drum 11, the effective length of blade 50 is preferably equal to the working width of drum surface 12 plus an amount equal to the stroke of blade movement to assure effective cleaning of the entire working width of drum 11. Blade 50 is preferably positioned so that edge 52 thereof extends toward drum 11 in a direction opposite to the direction in which drum 11 rotates so that blade angle between blade 50 and the plane tangent to drum 11 at the line of contact of the blade edge 52 with drum surface 12 is selected for optimum cleaning or scraping effect.

Blade 50 is comprised of any suitable flexible material, for example, polyurethane. Preferably, the blade material used should be relatively soft to prevent or minimize abrasion, scouring, scratching, etc., of the photoconductive surface 12 by the blade, yet allow effective cleaning of the surface 12.

To return toner removed from drum 11 to developer sump 29, there is provided a transfer auger 60. Auger 60 is carried on shaft 61 journaled in end caps 59, 59' of toner recovery housing 62.

The lower portion of toner recovery housing 62, together with blade 50, cooperate to form a channel-like recess 63 behind blade 50 into which toner removed by blade 50 deposits. Auger 60, which is operatively disposed within housing 62 adjacent recess 63 conveys toner accumulating in recess 63 laterally along recess 63 to inlet 65 of toner conduit 70. There, bead chain conveyor 66 carries the toner through leg 70' of toner conduit 70 to developer sump 29.

A gear-like drive sprocket 68 is provided for bead chain conveyor 66, sprocket 68 being supported by stub shaft 69 rotatably journaled in end cap 59' of toner recovery housing 62. Stub shaft 69 is conveniently driven from auger shaft 61 through suitable gearing means 67.

Leg 70' of toner conduit 70 leads from toner recovery housing 62 to sump 29 of developer housing 28, suitable openings 71 being provided in conduit 70 opposite sump 29 to enable the toner to be discharged therefrom. Toner conduit leg 70'' leads back to housing 62 to complete the toner recovery loop. As will be understood, the relative interior and exterior dimensions of toner conduit 70 and conveyor 66 are chosen to assure effective conveying of toner from recovery housing 62 through conduit 70 to developer sump 29.

To enhance the cleaning efficiency of blade 50, and avoid or at least reduce localized wear on the blade wiping edge 52 and trapping of toner or other foreign material between blade 50 and the drum surface 12, the blade 50 is slowly moved or oscillated back and forth across the drum surface whenever drum 11 is turning and up to a limited duration thereafter as will appear.

The apparatus just described includes the preferred toner cleaning system 19, however, it is believed that the contamination cleaning apparatus 80 of this invention can be used in conjunction with other types of conventional toner cleaning systems.

The contamination cleaning apparatus 80 comprises at least one scrubber member 81. The scrubber member is positioned between the toner cleaning system 19 and the charging station 20. The member 81 is significantly different in character than cleaning elements of the type conventionally employed for cleaning toner particles from xerographic plates. The principal characteristics by which it differs from those conventional elements is its greater degree of abrasiveness and the increased frictional force which it exerts against the photoconductor surface.

Referring now to FIGS. 2–4, the contamination cleaning apparatus 80 will be described in greater detail.

In accordance with this invention, the toner cleaning apparatus 19 must be an efficient one which is adapted to remove substantially all of the toner particles and other particles such as dust from the surface of the imaging member. The film removing efficiency of the scrubber member 81 can only be maintained over a long period of time if the surface which it is cleaning is free of toner. Excess toner on the scrubber member 81 will degrade the scrubbing action. The scrubbing member of this invention would not be adequately effective as a toner removal device. While it would undoubtedly remove some of the toner should toner be present on the imaging surface, it would not be operative to remove enough of it to be an operative cleaning system for that purpose. Further, if the scrubbing member 81 of this invention were operated in the fashion of a toner cleaning apparatus its greater degree of abrasiveness and frictional engagement with the drum surface would result in excessive abrasion of the imaging member surface. Therefore, the present means for removing film type contaminants does not represent a redundant cleaning system such as those suggested by the patents cited in the background of this invention, but rather it represents a system for a purpose entirely different from the purpose of the conventional toner removal system.

As an example of a contaminant removal means 80 in accordance with this invention the scrubbing member 81 in FIGS. 2 and 3, comprises a pad 82 type element which is mechanically biased into contact against the drum surface 11. The pad 82 extends across the drum surface in a direction transverse to the direction of rotation. In the pad 82 shown, the material which is frictionally engaging the drum surface comprises absorbent cotton fibers. The pad 82 may be pivoted against or away from the drum surface 11 by the same mechanism which is employed for the blade 50. That mechanism is shown and described in greater detail in U.S. Pat. No. 3,724,019, granted Apr. 3, 1973 to Shanley.

The pad 82 is biased against the drum surface with sufficient normal force to provide the necessary abrasiveness and degree of frictional engagement against the drum surface to remove the film-like contaminants. A force of from about 1 to about 4 lbs. per square inch preferably should be employed. This is believed to be a substantially greater force than would be applied by a conventional toner cleaning device.

By employing a stationary pad 82, namely, one that does not move in the same direction as the moving imaging surface, the relative movement between the surface of the pad which engages the drum surface and the drum surface itself comprises only the peripheral speed of the drum surface thereby reducing the abrasion of the drum surface by the pad. This invention, however, is not limited to stationary pads 82. Even though the pad 82 shown is stationary in the direction in which the surface 11 moves, it may be oscillated transverse to that direction just as the blade in U.S. Pat. No. 3,724,019 to reduce pad wear.

While the pad has been described with respect to the use of absorbent cotton fibers which comprises a wad of randomly oriented cotton fibers, other materials could be employed. Further, the pad instead of being a wad of cotton could comprise a brush-like element or it could be formed of a foam-like material, such as a polyurethane foam.

In U.S. Pat. Nos. 2,832,977, granted May 6, 1968, to Walkup et al.; and 3,682,689, granted Aug. 8, 1972, to Dultgen et al., there are disclosed a number of suitable toner cleaning brush fiber materials which may also be useful in accordance with this invention if they are selected to provide the greater degree of abrasiveness and frictional engagement. Mixtures of these various fibers could also be employed.

Among the materials which have been used in an apparatus similar to that shown in FIGS. 2 and 3, are Fibertran a product of the 3-M Company, Nomex felt, Nomex brush (nylon fibers), Dacron felt, Dacron No. 861D, polyester fibers, acrylic fibers, rayon fibers, billard cloth, Teflon, silicone sponge, cotton cloth, and Velcro. It has been found in accordance with this invention that the best results were obtained using the cotton fiber wad type material described above. Good results were also obtained utilizing the Dacron felt, Nomex felt, rayon fibers, cotton cloth, silicone sponge, and billard cloth.

In the apparatus shown, the pad member 82 is secured to a cantilever sping 83 which is effective to bias it against the drum surface 11. The opposing end of the cantilever spring is mounted to a support shaft 84 of the cleaning housing 62.

It is apparent from the foregoing description that no provision has been made in the apparatus 80 shown for removing contaminants or other matter from the contaminant removal scrubber member 81 of this invention. It is believed that the contaminants remain in or on the pad 82 which then can be periodically replaced to provide a fresh contaminant removal device. It is possible in accordance with this invention to utilize a scrubber member 81 without the necessity for some means for removing contaminants from it since the cleaning means 19 which comprises the blade 50 or other element is effective to remove substantially all of the residual particles such as toner from the drum surface 11 which might otherwise print-out on the copy sheet. If this were not the case it is clear as previously noted that the pad 82 would load up very quickly and loose its effectiveness as a contaminant removal device.

The omission of a cleaning system for the scrubber member 81 for removing contaminants from the scrubber means, is advantageous since it reduces machine noise and power requirements. The ability to employ a scrubber member 81 without a cleaning system for the scrubber pad 82 represents a significant advantage of this invention. It should be apparent, however, that if desired, a system for removing contaminants from the scrubber element 82 could be employed without departing from the present invention. The system shown and described herein represents an extremely compact arrangement which has the further advantage of being retrofitable into commercial apparatuses by virtue of its compact nature.

Figure 4A:
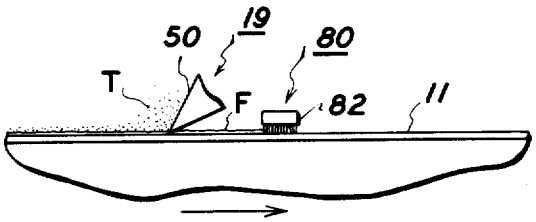
FIG. 4 is a series of side views showing alternative embodiments of the apparatus in accordance with the present invention.

Referring to FIG. 4A, an embodiment of the apparatus of this invention is shown employing a blade cleaning member 50 which removes substantially all the loose toner T and other particles from the surface of the imaging member 11 leaving the contaminant film F which would cause deletions in the resulting copy sheet. A brush pad 82 positioned immediately following the blade cleaning member 50 dislocates or breaks up the contaminant film and/or removes it so as to eliminate the deletions in the resulting copy sheet. Alternatively, instead of a brush as previously described, a foam pad or pad of other suitable material such as felt could be employed. The pad 82 shown in FIG. 4A does not move in the direction of drum rotation.

Figure 4B:
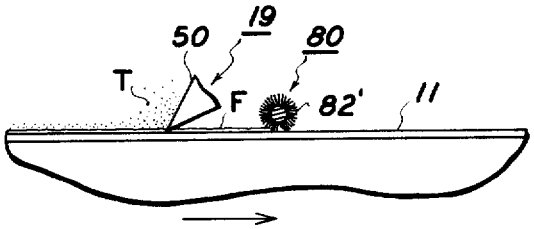

Referring now to FIG. 4B, an embodiment of a contaminant removal device is shown. The cleaning means 19 again comprises a blade cleaning member 50. Immediately following the blade cleaning member is a rotating brush element 82' which is sufficiently abrasive to dislocate and/or remove the contaminant film F from the surface 11 of the drum. The brush element 82' may be driven by any conventional means and is biased against the surface 11 by conventional means (not shown).

Figure 4C:
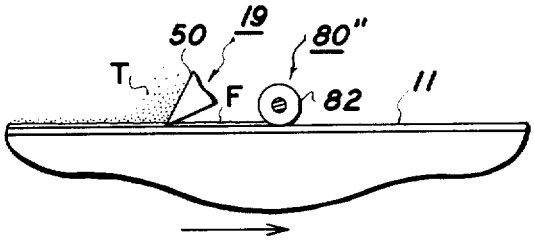

Referring to FIG. 4C, another embodiment of this invention is shown. Again, the cleaning means 19 comprises a blade cleaning member 50. Immediately following the blade cleaning member, a rotating elastomeric roller 82'' is employed to dislocate and/or remove the contaminant film. The foam roller may be formed of any desired material such as that set forth in U.S. Pat. No. 3,807,853, granted 4/13/74 to Hudson, which shows the use of a foam roll for toner cleaning. The use of the foam roll as a contaminant removal device 82'' following an operative toner removal device 19 is readily distinguishable from this patent with respect to the degree of abrasiveness exerted by the roll against the imaging member surface.

The process of this invention comprises providing an electrostatic imaging surface. The imaging surface is cleaned to remove residual toner and particulate contaminants such as dust. Following the cleaning step film-like contaminants are removed by scrubbing, preferably while applying a normal force of from about 1 to about 4 lbs. per square inch.

Preferably the process comprises a reproducing process including the following additional steps:

Forming a latent electrostatic image on the surface;

developing the latent electrostatic image to provide a visible powder image; and transferring the powder image to a sheet of final support material.

These steps are then followed by the previous cleaning and contaminant removal steps. The process may be carried out automatically by sequentially repeating these steps to produce a desired number of copies.

Preferably the reproducing process comprises a xerographic process wherein the latent electrostatic image is formed by first charging the electrostatic imaging surface followed by the steps of exposing an original document to provide an optical image thereof and projecting the image upon the charged electrostatic imaging member.

While the invention has been described with an apparatus and process for use in a xerographic type reproducing machine, it is equally applicable to other types of reproducing machines such as, for example, electrostatic printers.

The patents specifically referred to in this application are intended to be incorporated by reference into the application.

It is apparent that there has been provided in accordance with this invention, an improved cleaning system and process which fully satisfies the objects, means, and advantages set forth hereinbefore. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. In a reproducing apparatus including a moving photoconductive imaging surface, means for forming an electrostatic image on said surface, means for developing said image with toner particles to render it visible, means for transferring said developed image to a sheet of final support material, and blade cleaning means for cleaning said photoconductive imaging surface to remove substantially all of the residual toner particles therefrom, the improvement wherein, said apparatus further includes;

means following said blade cleaning means for substantially continuously engaging said imaging surface while it is moving for removing from said imaging surface film-like contaminants which can cause deletions in said image, said contaminant removing means comprising a scrubbing pad of fibers which scrub said surface to dislocate and remove said films, said pad being biased against said surface with a normal force of from about 1 to about 4 pounds per square inch.

2. An apparatus as in claim 1, wherein said pad does not move in the direction of movement of said photoconductive surface.

3. An apparatus as in claim 1, wherein said fibers comprise a brush.

4. An apparatus as in claim 1, wherein said fibers are selected from a group consisting of Teflon, nylon, rayon, acrylic, polyester, and cotton.

5. An apparatus as in claim 4, wherein said fibers comprise a wad of cotton fibers.

6. An apparatus as in claim 1, wherein said pad is biased against said surface in a cantilever fashion.

7. In a reproducing process including the steps of forming an electrostatic image on a moving photoconductive imaging surface; developing said electrostatic image with toner particles to render it visible; transferring said developed image to a sheet of final support material; and cleaning said imaging surface by biasing a resilient blade against said surface to remove substantially all residual toner particles therefrom the improvement wherein: following said cleaning step, said process further includes the step of removing from said imaging surface film-like contaminants which can cause deletions in said image, said film removing step including the step of biasing substantially continuously while said imaging surface is moving a scrubbing pad of fibers against said surface with a normal force of from about 1 to about 4 pounds per square inch.

8. A process as in claim 7, wherein said forming step comprises charging said photoconductive surface; and exposing an original document to provide an optical image thereof and projecting the image upon said photoconductive surface.

9. A process as in claim 8, wherein said pad does not move in the direction of movement of said surface.

10. A process as in claim 7, wherein said fibers are selected from the group consisting of Teflon, nylon, rayon, acrylic, polyester, and cotton.

11. A process as in claim 10, wherein said fibers comprise a wad of cotton fibers.

* * * * *